United States Patent [19]

Haaz et al.

[11] Patent Number: 4,488,575

[45] Date of Patent: Dec. 18, 1984

[54] VOLUME FLOW REGULATOR FOR VENTILATION SYSTEMS

[75] Inventors: Josef Haaz; Wolfgang Finkelstein, both of Neukirchen-Vluyn; Gregor Baumeister, Krefeld, all of Fed. Rep. of Germany

[73] Assignee: Gebr. Trox GmbH, Neukirchen-Vluyn, Fed. Rep. of Germany

[21] Appl. No.: 438,777

[22] Filed: Nov. 3, 1982

[30] Foreign Application Priority Data

Nov. 5, 1981 [DE] Fed. Rep. of Germany ..... 3143940

[51] Int. Cl.[3] ..... F16K 31/12

[52] U.S. Cl. ..... 137/499; 137/521

[58] Field of Search ..... 251/304, 305, 298, 309; 137/503, 499, 521; 98/41 R; 236/49

[56] References Cited

FOREIGN PATENT DOCUMENTS

| | | | |
|---|---|---|---|
| 546785 | 3/1932 | Fed. Rep. of Germany | 251/309 |
| 1600836 | 4/1970 | Fed. Rep. of Germany | 251/298 |
| 1226223 | 7/1960 | France | 251/298 |
| 2414160 | 9/1979 | France | 251/309 |
| 187236 | 10/1936 | Switzerland | 137/499 |
| 48112 | 12/1981 | U.S.S.R. | 251/304 |

*Primary Examiner*—Martin P. Schwadron
*Assistant Examiner*—James R. Shay
*Attorney, Agent, or Firm*—Shlesinger, Arkwright, Garvey & Fado

[57] ABSTRACT

The invention concerns a volume flow regulator for ventilation systems with a conduit section (1) in which a regulating part (3) is pivotably mounted about an axle (2) which bisects the conduit cross section, whereby the regulating part (3) has a basically even surface on its leading side and a length which corresponds to the conduit height.

In order to reduce the noises produced by the volume flow regulator itself, the regulating part (3) has a semicircular section in a plane vertical to its pivot axle (2), whereby the section radius corresponds to one half the conduit height. In a rectangular conduit section the regulating part (3) is a semicylinder whose curved contour fits against a conduit wall with a slight amount of play in all regulating positions. The regulating part can be balanced in various ways. In addition, a diffuser (24, 27) can be connected in after it which also functions as a sound absorber.

17 Claims, 6 Drawing Figures

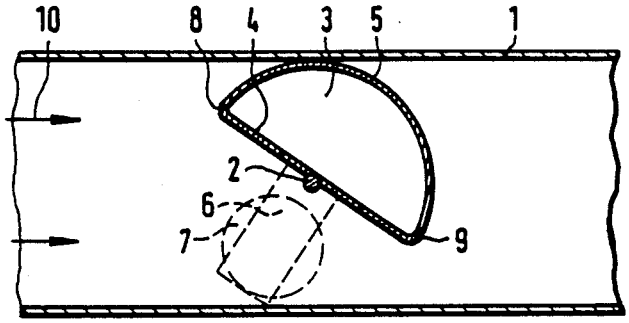
FIG.1
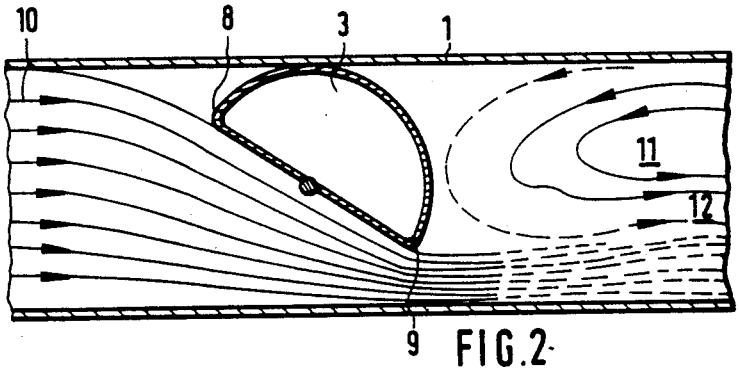
FIG.2
FIG.3
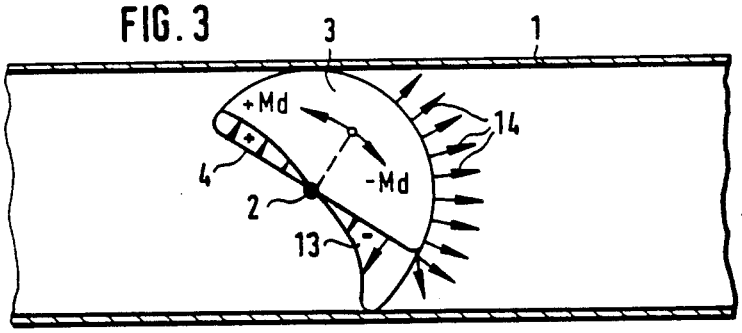

FIG. 4
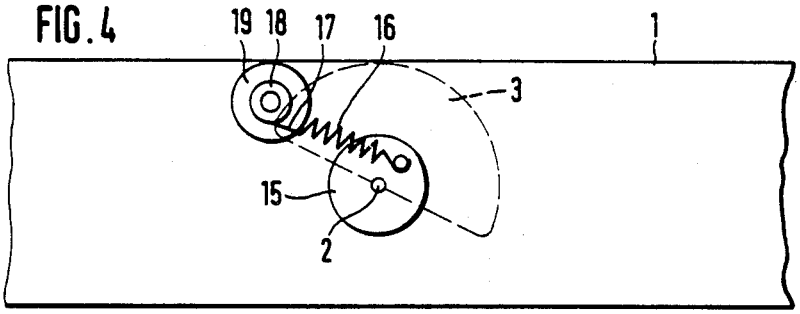
FIG. 5
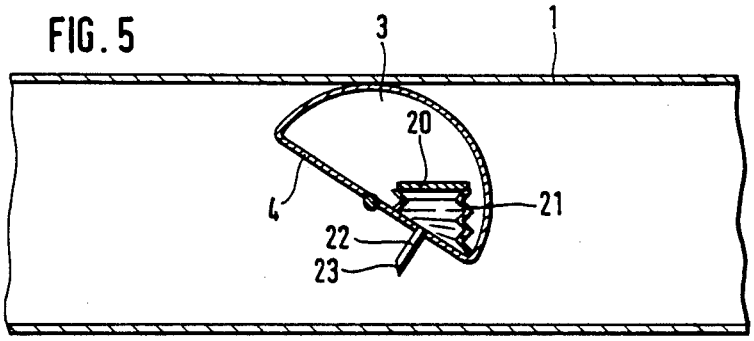
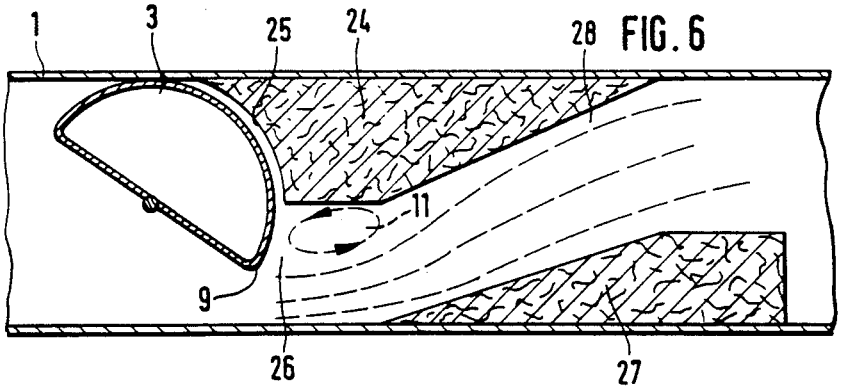
FIG. 6

VOLUME FLOW REGULATOR FOR VENTILATION SYSTEMS

The invention concerns a volume flow regulator for ventilation systems with a conduit section in which a regulating part is mounted so that it can pivot about an axle which bisects the conduit section. The regulating part has an essentially level surface on its leading side as well as a length which corresponds to the conduit height.

A great number of volume flow regulators are required in ventilation systems, especially in air-conditioning systems. They should assure that the required volume flow enters an area to be air-conditioned within close tolerances, independently of the pressure conditions and pressure variations in the total system. The requirements placed on a volume flow regulator can be described in general as follows: The exiting volume flow should deviate from the theoretical volume flow only within a small tolerance range. A small total pressure difference in front of and in back of the volume flow regulator should be sufficient to set the theoretical volume flow. In as far as pressure variations occur in the system, they should be dampened aperiodically, if possible, in the volume flow regulator. The noise made by the volume flow regulator itself should be as low as possible. In certain instances the theoretical amount of air should also be adjustable, because it can change if more or less people are in the area to be air-conditioned or if machines are turned on or off. Finally, a volume flow regulator should be able to be put into the conduit system at any geometric position.

There are many different volume flow regulators. These volume flow regulators usually have a flap as their regulating part, which is balanced in such a manner with the aid of weights, springs and/or damping members that it meets the desired requirements. Such a flap is usually mounted about an axle running through the middle of the conduit section and can pivot about this axle. The air which passes the volume flow regulator flows both over and under the flap. The result of this is flow separations both on the upper and on the lower edge of the flap and the formation of a disordered dead water area downstream from the flap, which is where low sound frequencies are produced which are difficult or even impossible to dampen.

The invention therefore has the task of minimalizing noises produced by the volume flow regulator itself.

This task is solved as follows: The regulating part has a semicircular section in a plane vertical to its axis of rotation, whereby the section radius corresponds to one half of the conduit height.

In the volume flow regulator of the invention at least one half of the conduit section is constantly covered by the regulating part, because this part lies snugly with its cylindrical contour against the top resp. the bottom of the conduit. It is understood that a certain, very small amount of play is present between the cylinder contour and the associated conduit wall, in order that the regulating part can still be pivoted about its axle. In any case, this arrangement means that flow separations occur only on the edge of the regulating part projecting into the open conduit area, whereby only a single backflow eddy with an ordered dead water develops, which makes much less noise than a disordered dead water does. For the rest, a pressure field of a confuser current forms on the leading side of the regulating side loaded by the flowing air. All pressure forces are directed radially on the back side of the regulating part formed by the semicircular sections, so that they can not exert any torque on the regulating part. As a consequence, an aerodynamic torque acts on the regulating part which is determined exclusively by the pressure distribution on the leading side. The torque becomes zero when the leading side of the regulating part extends parallel to the longitudinal axis of the conduit section or when it is vertical to it.

Particularly favorable and easily understandable conditions are achieved if the conduit section has a rectangular section and the regulating part is a semicylinder. The sensitivity of response of the volume rate regulator is improved if the regulating part is a hollow body. The acoustic qualities of this volume flow regulator are favorably affected if the edges of the regulating part are rounded in the transitional area between the cylinder contour and the leading side. Air then flows almost without flow separations around the edge directed against the direction of flow, while the rounding of the edges directed in the direction of flow favorably affects the backflow eddy and therewith the dead water area in the sense of a diminution of noise.

The regulating part is mounted on a shaft which extends through the conduit wall and carriers a lever with a compensating weight outside of the conduit section. The eigenweight of the regulating part can be compensated for in such a way with the aid of this compensating weight, which is movably fastened to the lever in a preferred embodiment, that a practically indifferent equilibrium prevails, so that it is possible to position the volume flow regulator in any geometric position in the system without effects of weight torque occurring.

A possibility for increasing the torque of the regulating part is present if a plate fixed to the conduit is located inside the hollow regulating part, between which plate and the even wall of the regulating part a yielding bellows is supported which has an opening running through the even wall. The aerodynamic torque of the regulating part can be positively influenced, depending on at what position in the wall the opening is located, i.e. in what area of the pressure field on the leading side.

An influencing of the aerodynamic torque independently of the pressure field on the leading side is obtained if the bellows opening is formed by a fill tube which extends beyond the leading side of the regulating part into an area which is hardly or not at all influenced by the pressure field on the leading side. The free end of the fill tube should be cut off obliquely, so that the oblique surface runs essentially vertically to the direction of flow and the opening on the free end of the fill tube is exposed to practically the full dynamic pressure of the flow. The pressure at the end of the fill tube also loads the bellows, which for its part exerts a desired toqure on the regulating body. At the same time the bellows also produces an aperiodic damping of the regulating part, whereby the degree of damping is dependent on the length and the internal diameter of the fill tube. The reaction speed of the regulating part can thus be set by altering the dimension of the fill tube. For example, in the case of rapidly fluctuating flow conditions narrower tube sections are selected than in the case of slowly fluctuating flow conditions. This arrangement operates without hysteresis and makes an additional oscillation damper superfluous.

A return spring acting between the regulating part and the conduit section can also be provided independently of the above or in combination with it. It is advantageous to locate this return spring outside the conduit section, whereby it touches the shaft eccentrically, e.g. on the lever or on a disk attached to the shaft.

The return spring can easily be set or adjusted to adapt to conditions by connecting a wire or the like to the spring end associated with the conduit section, which wire runs about and is attached to an adjustable roller mounted on the outside of the conduit section. When the roller is turned, the wire running to the spring is wound up on the roller, thus tensioning the spring, and vice versa. The theoretical amount is set by setting the spring tension correspondingly.

The roller can also be provided wth a motor adjustment drive, so that the adjusting of the spring tension and of the theoretical amount do not have to be performed manually.

If a motor adjustment drive is present, it can also be constructed as a correcting element of a regulating circuit which regulates the temperature of the area, for example.

It is important for the functioning of the volume flow regulator, regardless of whether it is to operate automatically or with external electrical or pneumatic auxiliary energy, that the moment produced by the return spring cancels out to a great extent the sum of the aerodynamic torque and of the torque applied by the bellows at all setting angles of the regulating part. This can be achieved by a suitable construction of the spring, e.g. by a cylindrical or conical spring.

The flow conditions downstream from the regulating part of this volume flow regulator can be improved if a diffuser is connected in directly after the regulating part in the direction of flow which has a baffle at least in the conduit half covered in the open position of the regulating part. This baffle leaves an entry cross section free which corresponds to the conduit section which remains in the open position of the regulating part and is in alignment with it. This allows the dead water area behind the regulating part to be diminished considerably, the pressure loss to be reduced and the flow to be evened out. In addition, the diffuser can have another baffle located on the opposite side.

If the baffles are also constructed as sound absorbers, noises arising in the area of the dead water are directly dampened and the radiation of sound into the following guide system is considerably diminished. For example, thick sound-deadening mats can be built in which achieve an especially effective absorption of sound in the 125 to 500 Hz range.

Embodiments of the invention which are shown in the drawings are explained below.

FIG. 1 is a scheme of a longitudinal section through a volume flow regulator.

FIG. 2 shows the object of FIG. 1 with flow lines sketched in.

FIG. 3 shows the object of FIG. 1 with the pressure field sketched in.

FIG. 4 shows another embodiment of the object of FIG. 1.

FIG. 5 shows another embodiment of the object of FIG. 1.

FIG. 6 shows the volume flow regulator with a diffuser and sound absorbers added in on the downstream side.

The volume flow regulator shown in FIG. 1 has a housing 1 constructed as a conduit section and with a rectangular cross section. Shaft 2 is located in the middle of housing 1 and carries regulating part 3. Shaft 2 is mounted in the housing walls. Regulating part 3 is a hollow body with an even wall 4 which forms the leading side of regulating part 3 and with a circularly curved wall 5, so that viewed as a whole regulating part 3 has a semicircular section, the cross sectional radius of which corresponds to approximately one half the height of housing 1. As can be seen from FIG. 1, the arrangement is such that regulating part 3 can pivot about the axis formed by shaft 2, whereby its circular wall 5 is guided with only a little amount of play under the upper housing wall.

Shaft 2 extends out of housing 1 at least on one side, where it carries a lever 6 with compensating weight 7 which is movably fastened to lever 6.

Edges 8, 9 of regulating part 3 are rounded off in the transitional area between circular wall 5 and even wall 4.

FIG. 2 illustrates the conditions of flow when air flows toward regulating part 3 in the direction of arrows 10. Air flows against upstream side 8 practically without impact. The flow separates behind downstream edge 9 and forms a backflow eddy 11, whereby an ordered dead water area 12 is created in which relatively few noises are produced.

While air is flowing through the volume regulator a pressure field 13 is produced on the leading side, respectively, on even wall 4 on the regulating body, which is comparable to a confuser. A static superpressure prevails on the left half (FIG. 3) of level wall 4. The pressure drops with the conduit section, which decreases in the direction of flow, so that a subpressure prevails approximately to the right of shaft 2. Pressure field 13 shows that a torque acts on regulating part 3 about the axis formed by shaft 2. This torque becomes approximately zero when the leading side of regulating part 3 resp. its even wall 4 extends in the direction of the conduit axis, or when even wall 4 is vertical to the conduit axis. In comparison thereto, the pressure forces acting on the downflow side on circular cylindrical surface 5 are inconsiderable, because they are radially directed across forces 14 which exert no torque on regulating part 3.

Regulating part 3 can be balanced in such a way by compensating part 7 that the functioning of the volume flow regulator is assured in every geometrical position it is built into.

In the embodiment shown in FIG. 4 the same reference numberals designate the same parts. Regulating part 3 is located as described on shaft 2 which extends past the conduit wall and carries disk 15 on the outside, which spring 16 touches eccentrically. The other end of the spring is fastened to wire 17, which is wound around roller 18, where it is fastened. Roller 18 is concentrically connected to disk 19, which can be fixed in different positions. When disk 19 is rotated, wire 17 running to spring 16 is wound up on resp. off of roller 18, which tensions or releases spring 16. This also changes the setting characteristic of regulating part 3 and therewith the theoretical amount flowing through the volume flow regulator. When disk 19 has been set, it is fastened in a known manner to the conduit wall.

It is not shown that disk 19 can also have a motor adjusting drive, e.g. a pneumatic or electrical drive. In this manner disk 19 and therewith the theoretical amount can be set from a remote location. The adjusting motor can also be constructed as a correcting element of a regulating circuit which regulates, for example, the room temperature and has a temperature regulator for this purpose.

The embodiment described in conjunction with FIG. 4 with spring 16 can be made either in combination with the embodiment of FIG. 1 with compensating weight 7 or without compensating weight 7. If the volume flow regulator is to operate automatically, that is, without external electrical or pneumatic auxiliary energy, it is only important that the moment produced by spring 16 cancels out to a large extent the torque produced on regulating part 3 by aerodynamic forces.

The same reference numerals also designate the same parts in the embodiment shown in FIG. 5. Here, a plate 20 supported on opposite conduit walls extends through hollow regulating body 3. This plate is located somewhat above the longitudinal axis of housing 1 in the embodiment shown and its plane extends essentially in the direction of the longitudinal axis. An elastic bellows 21 is supported on the bottom of this plate 20 as well as on the inside of even wall 4 of regulating part 3. Bellows 21 has an opening formed by a fill tube 22. Fill tube 22 runs basically vertically to even wall 4 and past it into an area which is no longer disturbed or is disturbed only slightly by the developing pressure distribution. The free end of fill tube 22 is cut off obliquely, so that oblique surface 23 runs essentially vertical to the flow and loads the full dynamic pressure of the flow at the lower opening of fill tube 22.

Bellows 21 is inflated by the dynamic pressure, creating a moment which is equidirectional with the aerodynamic moment. At the same time, bellows 21 together with fill tube 22 also forms a construction element for the aperiodic damping of the oscillations of regulating part 3. The length and the internal diameter of fill tube 22 are important features in this connection. The reaction speed of regulating part 3 to fluctuations of pressure in the conduit systems depends on them. For example, in the case of rapidly fluctuating flow conditions, narrower cross sections of fill tube 22 are selected than in the case of slowly fluctuating flow conditions. In addition, fill tube 22 can also have a throttle (not shown).

The arrangement according to FIG. 5 can be used in combination with the embodiments of FIG. 1 and/or 4.

In the embodiment of FIG. 6 the same reference numerals again designate the same parts. Here, a diffuser is located downstream from regulating part 3. The diffuser has an upper baffle 24 whose contour 25 directed against the direction of flow is adapted to the cylinder contour of regulating part 3, so that regulating part 3 and baffle 24 form a unit in a fluidic sense when regulating part 3 is in its position of rest, that is, when its even wall 4 extends in the direction of the longitudinal axis of housing 1. Otherwise, the baffle in the embodiment shown extends only to the middle of housing 1, so that the diffuser leaves an entry section 26 open which corresponds to the section left open by the completely opened regulating part 3. If regulating part part 3 is pivoted, e.g. into the position shown in FIG. 6, the backflow eddy 11 which forms behind edge 9 is much smaller than the one in FIG. 2, for example. Thus, the pressure losses are also less.

The diffuser also has a baffle 27 located on the opposite conduit wall. Both baffles 24 and 27 form a diffuser conduit 28 between themselves which can be arranged as desired.

Baffles 24 and 27 are constructed as sound absorbers. In the embodiment shown they consist of relatively thick sound-deadening mats which achieve an especially damping of sound in the 125 to 500 Hz range. The bent form of the diffuser shown is especially useful. Noises produced on or behind regulating part 3 are directly dampened and the sound radiation of the volume flow regulator into a following guide system is reduced to a large extent by the bent form.

We claim:

1. A volume flow regulator for ventilating systems, comprising:

(a) a generally rectangular conduit section of substantially constant non-interrupted cross section;

(b) a shaft pivotally mounted in said conduit section substantially equidistant a parallel two sides of said conduit section;

(c) a regulating part secured to said shaft and pivotal therewith whereby pivoting thereof regulates flow through said conduit section;

(d) said regulating part includes an even wall connected to said shaft having a length substantially spanning the distance between another parallel two sides of said conduit section;

(e) a semicircular section extends from said even wall at opposed ends thereof; and (f) the area connecting each of said ends with said semicircular section is rounded off for thereby minimizing noise produced by flow through said regulator.

2. The regulator as defined in claim 1, wherein:

(a) said regulating part is hollow.

3. The regulator as defined in claim 1, wherein:

(a) a portion of said shaft extends outwardly beyond a wall of said conduit section;

(b) said regulating part is mounted to said shaft;

(c) a lever member is secured to said portion; and, (d) a compensation weight is secured to said lever.

4. The regulator as defined in claim 3, wherein:

(a) said compensation weight movably secured to said lever member.

5. The regulator as defined in claim 2, wherein:

(a) a plate is secured to a wall of said conduit section and extends into said regulating part;

(b) an opening disposed in said even wall; and, (c) a yielding bellows secured to said plate and to said even wall communicates with said opening.

6. The regulator as defined in claim 5, wherein:

(a) a fill tube mounted in said opening extending outwardly beyond said even wall.

7. The regulator as defined in claim 6, wherein:

(a) said fill tube has an oblique free end extending generally vertically to the direction of flow through said regulator.

8. The regulator as defined in claim 1, wherein:

(a) a return spring is connected to said regulating part and to a wall of said conduit section.

9. The regulator as defined in claim 8, wherein:

(a) a portion of said shaft extends outwardly beyond a wall of said conduit section; and, (b) said return spring is eccentrically connected to said portion and to an outside portion of a wall of said conduit section.

10. The regulator as defined in claim 9, wherein:

(a) a lever member secured to said portion; and (b) said return spring connected to said lever member.

11. The regulator as defined in claim 9, wherein:

(a) a disk mounted to said portion; and, (b) said return spring connected to said disk.

12. The regulator as defined in claim 9, wherein:

(a) an ajustable roller externally mounted to an outside wall portion of a wall of said conduit section; and, (b) a wire connected to one end of said spring is fastened to said adjustable roller.

13. The regulator as defined in claim 12, wherein:

(a) adjustable motor drive means are connected to said adjustable roller.

14. The regulator as defined in claim 8, wherein:

(a) said return spring is a coil spring.

15. The regulator as defined in claim 11, further comprising:

(a) a diffuser disposed in said conduit section downstream of said regulating part in flow communication with said regulating part;

(b) a baffle disposed in said diffuser secured to one wall of said conduit section; and, (c) an entry section in said diffuser corresponding to and in flow alignment with said regulating part.

16. The regulator as defined in claim 15, wherein:

(a) another baffle is secured to a wall of said conduit section opposite said one wall.

17. The regulator as defined in claim 16, wherein:

(a) said baffles are sound absorbers.

* * * * *